US005103235A

United States Patent [19]

Clemens

[11] Patent Number: 5,103,235

[45] Date of Patent: Apr. 7, 1992

[54] ANTENNA STRUCTURE FOR AN ELECTRONIC ARTICLE SURVEILLANCE SYSTEM

[75] Inventor: Thomas G. Clemens, Glassboro, N.J.

[73] Assignee: Checkpoint Systems, Inc., Thorofare, N.J.

[21] Appl. No.: 292,361

[22] Filed: Dec. 30, 1988

[51] Int. Cl.[5] ..... H01Q 7/040; G08B 13/220

[52] U.S. Cl. ..... 343/742; 340/572; 343/842; 343/867

[58] Field of Search ..... 343/742, 744, 841, 842, 343/853, 867, 741; 340/572

[56] References Cited

U.S. PATENT DOCUMENTS

| | | | |
|---|---|---|---|
| 2,226,687 | 12/1940 | Alford | 343/735 |
| 2,494,198 | 1/1950 | Posthumus | 343/735 |
| 4,217,591 | 8/1980 | Czerwinski | 343/744 |
| 4,229,742 | 10/1980 | Rotunda | 343/742 |
| 4,308,530 | 12/1981 | Kip et al. | 340/572 |
| 4,494,120 | 1/1985 | Garay | 343/702 |
| 4,633,250 | 12/1986 | Anderson, III et al. | 340/572 |
| 4,872,018 | 10/1989 | Feltz et al. | 343/742 |

FOREIGN PATENT DOCUMENTS

| | | | |
|---|---|---|---|
| 8200378 | 2/1982 | World Int. Prop. O. | 343/842 |

*Primary Examiner*—Michael C. Wimer
*Assistant Examiner*—Peter Toby Brown
*Attorney, Agent, or Firm*—Weiser & Stapler

[57] ABSTRACT

The transmitting and/or receiving antenna of an electronic article surveillance system utilizes a paired-lead loop configuration. One lead forms the active loop.

The other lead forms a passive loop, which parallels and is mutually coupled to the active loop, but not conductively connected to it. This other lead is resistively loaded.

The passive loop of the receiving antenna can also be used to conduct signals between the receiver circuitry and the alarm reporting devices associated with the receiver.

17 Claims, 2 Drawing Sheets

FIG. 1
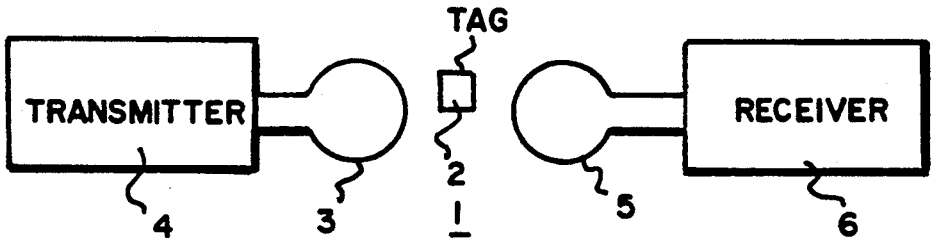
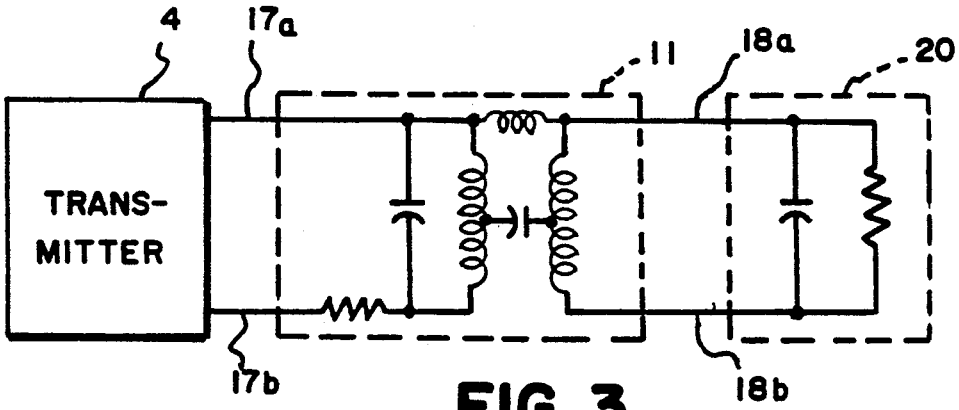
FIG. 3
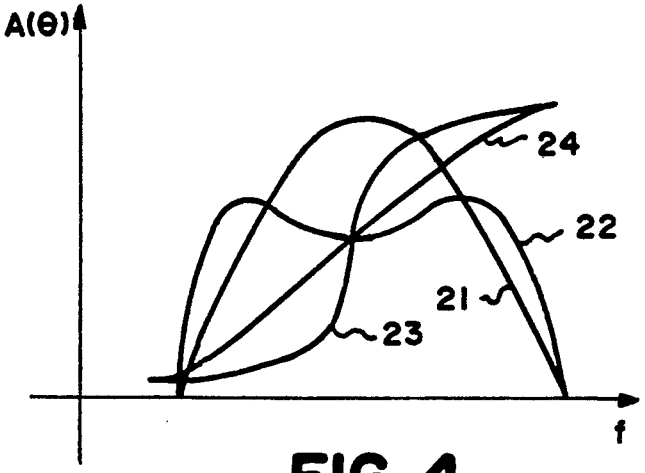
FIG. 4

ANTENNA STRUCTURE FOR AN ELECTRONIC ARTICLE SURVEILLANCE SYSTEM

BACKGROUND OF THE INVENTION

The present invention primarily relates to electronic security systems, and in particular, to an improved antenna structure for an electronic article surveillance system.

A variety of electronic article surveillance systems have been proposed and implemented to restrict the unauthorized removal of articles from a particular premises. One common form of this is the electronic article surveillance system which has come to be placed near the exits of retail establishments, libraries and the like. However, electronic article surveillance systems are also used for purposes of process and inventory controls, to track articles as they pass through a particular system, among other applications.

Irrespective of the application involved, such electronic article surveillance systems generally operate upon a common principle. Articles to be monitored are provided with tags (of various different types) which contain a circuit (a resonant circuit) for reacting with an applied radio-frequency field. A transmitter and a transmitting antenna are provided to develop this applied field, and a receiver and a receiving antenna are provided to detect disturbances in the applied field. If the active circuit of a tag is passed between the transmitting and receiving antennas (which are generally placed near the point of exit from a given premises), the applied field is affected in such fashion that a detectable event is produced within the receiver. This is then used to produce an appropriate alarm. Systems of this general type are available from manufacturers such as Checkpoint Systems, Inc., of Thorofare, N.J., among others.

Although such systems have proven effective in both security as well as inventory and process management, it has been found that certain enhancements to such systems would be desirable. Perhaps foremost is the ever-present desire to reduce to the extent possible any errors (e.g., false alarms) which are produced by such systems, particularly in terms of their discrimination between the presence of a tag (signifying the presence of a protected article) and other interference which may be present in the vicinity of the electronic article surveillance system. Any steps which can be taken to enhance the accuracy of the system will tend to reduce such undesirable results. However, complicating this is the corresponding and at times conflicting requirement that any fields which are produced by the system must meet prevailing FCC regulations, limiting the nature (frequency, intensity, etc.) of the fields which may be used in making such determinations.

One factor which contributed to this relates to the antenna structures which are used in conjunction with the system's transmitter and receiver, in order to develop and pick up the particular radio-frequency signals which are utilized in such systems. In particular, the known antenna structures had response characteristics, within the range of radio frequencies typically employed, which could introduce amplitude and/or phase distortions into these signals which were sufficiently pronounced to contribute to false alarms.

SUMMARY OF THE INVENTION

It is therefore a primary object of the present invention to provide an electronic article surveillance system of improved accuracy and reliability.

It is also an object of the present invention to provide an electronic article surveillance system which can accurately and reliably react to an increased proportion of the labels or tags which it encounters.

It is also an object of the present invention to provide an improved antenna configuration for an electronic article surveillance system which permits the system to more effectively discriminate between the signal produced by a tag passing in the vicinity of the electronic article surveillance system, and potential sources of interference.

It is also an object of the present invention to provide an antenna system of improved amplitude response for use in conjunction with electronic article surveillance systems or other applications having similar operating requirements.

It is further an object of the present invention to provide an antenna system of this general type which can increase the sensitivity of the system to tag signal components, while decreasing its sensitivity to undesirable signal components.

It is further an object of the present invention to provide an antenna system which is capable of operating with a comparatively constant (or flat) amplitude response across a predetermined frequency range within which it is to operate.

These and other objects are achieved in accordance with the present invention by providing an electronic article surveillance system with an improved antenna configuration, as follows. The transmitting antenna for the system utilizes, in place of the single-lead or single coaxial-cable loop antennas of the prior art, a "paired-lead" loop antenna configuration. The term "paired-lead" includes not only the twin-axial cable which is currently preferred for use, but also other arrangements of two parallel leads, such as so-called "zip cord", paired coaxial cables and the like. Within each set of paired-leads, one lead forms an "active" antenna loop, i.e. one which is driven by the tramsmitter circuitry, in the case of the transmitting antenna, and which drives the receiver circuitry in the case of the receiver antenna. The other lead forms a "passive" loop, i.e. one which is not driven or driving, but rather interacts with the respective active loop only through mutual coupling between them. The passive loop can then be appropriately passively loaded, and the combination of active and passive loop will then exhibit the desired flattened amplitude and linearized phase response. However, this beneficial effect will be obtained without substantially detracting from the efficiency of the antenna which is so configured.

In addition, one of the paired leads, preferably the passive one, can supply energizing signals from the receiver circuitry to the alarm devices of the system (e.g., warning light or buzzer), whenever a tag is detected.

Further detail regarding an antenna system having these capabilities may be had with reference to the detailed description which is provided below, taken in conjunction with the accompanying drawings.

BRIEF DESCRIPTION OF THE DRAWINGS

FIG. 1 is a block diagram of a conventional electronic article surveillance system.

FIG. 3 is a schematic diagram of an equivalent circuit for the antenna system shown in FIG. 2*a*.

FIG. 4 is a graph which illustrates the frequency and phase response of the antenna systems shown in FIG. 2.

In the several views provided, like reference numerals denote similar elements.

DETAILED DESCRIPTION OF THE PREFERRED EMBODIMENT

Figure 2A:
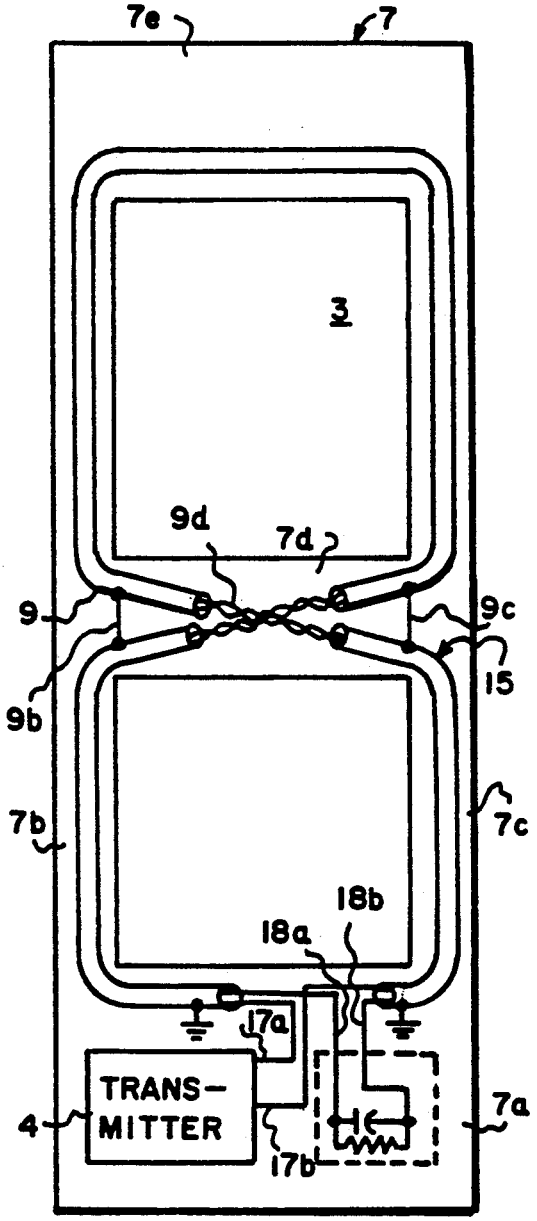
FIGS. 2*a* and 2*b* are diagrammatic plan views showing an improved antenna system for use in conjunction with the transmitting and receiving portions of the electronic article surveillance system of FIG. 1.

FIG. 1 shows (in block diagram form) what generally constitutes the conventional components of an electronic article surveillance system 1 of the type manufactured by and available from Checkpoint Systems, Inc., of Thorofare, N.J. This system 1 includes a tag 2, which can be applied to any of a variety of different articles in accordance with known techniques. For example, the tag 2 may take the form of a "hard" tag which is attachable to an article, using the connecting pin with which this type of tag is generally provided. Alternatively, the tag 2 may take the form of a hang-tag which is appropriately tied to the article. The tag 2 may also take the form of a label adhesively affixed to the article. Any of a variety of types of tags and application techniques may be used to accomplish this general task.

Irrespective of the type of tag which is used, or its manner of attachment to the associated article, the tag 2 incorporates a resonant circuit (not shown) which is capable of reacting to applied fields of electromagnetic energy. A transmitting antenna 3 is provided which is capable of developing these applied fields responsive to the operation of associated transmitter circuitry 4. A receiving antenna 5 is provided for receiving electromagnetic energy both from the transmitting antenna 3 and the resonant circuit of the tag 2 to develop a signal which is in turn applied to receiver circuitry 6. The receiver 6 then operates upon this received signal to determine whether a tag 2 is present in the vicinity of the transmitting and receiving antennas 3,5, and to give an alarm if such is the case.

Figure 2B:
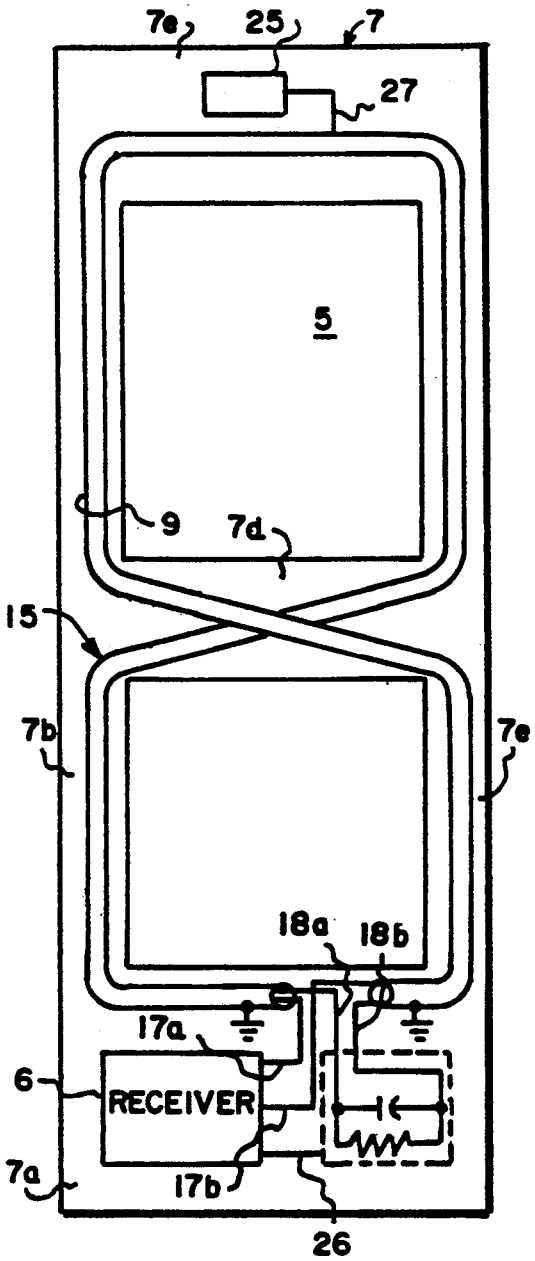

Referring now to FIGS. 2*a* and 2*b* of the drawings, these show the manner in which antennas embodying the present invention may be configured and mounted.

FIG. 2*a* shows this for the transmitting antenna 3, FIG. 2*b* for the receiving antenna 5.

In each case, there is provided a housing 7. In its presently preferred embodiment, this housing 7 is made of a hollow synthetic plastic body, in whose interior all the other elements are positioned. Specifically in the base portion 7*a* of FIG. 2*a*, there is located the transmitter circuitry 4 (FIG. 1) while, in the base portion 7*a* of FIG. 2*b*, there is located the receiver circuitry 6 (FIG. 1).

Each housing 7 has a pair of uprights 7*b* and 7*c*, which are connected by cross-members 7*d* and 7*e*.

In each housing 7, the antenna loop 15 starts at the base portion 7*a* and extends upwardly on one side of the loop into upright portion 7*b* and on the other side into upright portion 7*c*. However, at cross-member 7*d*, these sides of the antenna loop 15 change places, i.e. the portion extending along upright 7*b* switches over to upright 7*c* and vice-versa. The antenna loop 15 is then completed within cross-member 7*e*.

This crossing over of the upper and lower portions of each antenna loop 15 is what creates far-field cancellation of the antenna patterns, as appropriate to satisfy FCC regulations, as well as to reduce interference from remote sources of extraneous radio frequency energy. This technique of using one or more such cross-overs is known, and in itself, does not constitute an element of the present invention.

What does constitute the present invention is that the antenna loop 15 is formed of paired leads, which are preferably embodied in a twin-axial cable.

Such a cable comprises an insulating sleeve, within which extends a pair of separate leads, surrounded by a conductive shield. A conductor for grounding the shield is also provided, and spacers are twisted in with the leads to maintain substantially uniform spacing of the elements within the outermost insulating sleeve.

In FIGS. 2*a* and 2*b*, this cable is represented somewhat diagrammatically by tubular element 9 and by conductor pairs 17*a*, 17*b* and 18*a*, 18*b*, which are seen to emerge from the open lower ends of element 9. Specifically, element 9 represents the conductive shield of the twin-axial cable; conductor pairs 17*a*, 17*b* and 18*a*, 18*b* represent the separate leads inside the cable, which become visible in FIGS. 2*a* and 2*b*, where they emerge from the inside of shield 9, near the transmitter and receiver circuitry 4 and 6, respectively.

More specifically, conductors 17*a* and 17*b* represent the so-emerging opposite ends of the same one of the two separate leads inside shield 9; conductors 18*a* and 18*b* represent the opposite ends of the second one of the two separate leads inside shield 9.

As shown in FIG. 2*a*, transmitter circuitry 4 is connected to that one lead whose emerging ends are designated by reference numerals 17*a*, 17*b* in FIG. 2*a*. This transmitting circuitry thus constitutes an "active" load for this lead and the loop which that lead forms inside shield 16 constitutes the "active" loop of the transmitting antenna.

In FIG. 2*b*, it is the receiver circuitry 6 which is connected to that one lead whose emerging ends are similarly designated by reference numerals 17*a*, 17*b* in FIG. 2*b*. Accordingly, in FIG. 2*b*, it is the receiving circuitry which constitutes an "active" load for this lead and the loop which that lead forms inside shield 16 in FIG. 2*b* constitutes the "active" loop of the receiving antenna.

We now turn to the other lead inside each shield 9, namely that lead whose emerging ends are designated by reference numerals 18*a*, 18*b* in each of FIGS. 2*a* and 2*b*. These other leads are not connected to the respective active loads (namely to transmitter or receiver circuitry 4, 6). Rather the emerging portions 18*a*, 18*b* of these leads are connected in each of FIGS. 2*a* and 2*b* to a "passive" load 20 and the loop which each of these leads forms inside its shield 9 thus constitutes the "passive" loop of the respective antenna.

Each of these passive loops is in turn coupled to the active loop inside the same shield 9 by means of the mutual coupling which exists between two closely adjacent leads.

The impedance of passive load 20 is so chosen that, when it is reflected back into the respective active load through the above-mentioned mutual coupling, the overall effect will be to impart to each antenna loop 15 a much flatter amplitude response and a much more linear phase response than could otherwise have been obtained, without substantially reducing the antenna efficiency.

Because of the distributed nature of the mutual coupling between the leads inside each shield 9, it is difficult to provide a precise equivalent circuit for the arrangement. An approximation of such an equivalent circuit for the transmitter portion of the system is shown in FIG. 3 within the broken line rectangle designated by reference numeral 19.

As illustrated in FIG. 4, to which reference may now be made, the use of a second lead in the manner embodying the present invention changes the antenna amplitude response from one which is generally similar to that shown at 21 in FIG. 4, to one which is generally similar to that shown at 22, i.e. to one which is significantly more uniform throughout the operative frequency band. Also illustrated in FIG. 4 is a corresponding improvement in the antenna's phase response, from a response generally like that shown at 23, to a comparatively more linear response such as shown at 24.

By so flattening the antennas' amplitude response and linearizing their phase response, it becomes possible to effectively detect tag signals over a wider range of frequencies, without creating more false alarms. This is important because the resonant circuit, which is part of each tag 2, tends to vary in resonant frequency from one tag to another. Because of this, conventional practice requires a swept frequency to be utilized by the system (e.g., 8.2 MHz±800 KHz) so as to effectively interact with such tags despite their variation in resonant frequency. Even then, some tags had to be rejected following their manufacture because they could not satisfy the tolerance requirements for the electronic article surveillance system with which they were to be used. By making it possible to effectively detect a broader range of frequencies, the electronic article surveillance system 1 of the present invention will operate to detect a wider range of resonant tags, in turn permitting a significantly reduced number of tags to be rejected in the course of their manufacture.

Using a twin-axial cable as the receiving antenna 5 provides an additional advantage for the system 1. It is the principal function of the receiver 6 to activate an appropriate alarm when the presence of a tag 2 is detected between the transmitting antenna 3 and the receiving antenna 5.

To that end, there may be mounted inside the upper cross member 73 of housing 7 in FIG. **2*b* a conventional warning light arrangement diagrammatically represented by rectangle 25. In order to energize this warning light when required, a d-c connection needs to be provided between it and the receiver 6 located in the base 7*a* of the housing 7. The passive lead (the one whose emerging ends are designated by reference numerals 18*a* and 18*b* in FIG. 2*b*) may be used for that purpose. Specifically, d-c output from receiver 6 may be applied to that lead via a connection which is diagrammatically represented by lead 26 in FIG. 2*b*. At the top of the loop formed by the twin-axial cable, a connection is made to the same passive lead near the warning light arrangement 25, as diagrammatically represented by connecting lead 27 in FIG. 2*b*. As a result, there is no need for a separate, additional lead between receiver 6 and warning light 25**. Potential adverse effects on antenna performance, resulting from the presence of such an additional lead, are thereby averted.

It will now be seen that the above-described antenna systems operate to satisfy the various objectives which were previously stated. It will further be understood that these antenna systems may be varied, if desired, without departing from the spirit and scope of the present invention.

For example, although the improvements of the present invention are specifically described in connection with a particular type of electronic article surveillance system, such improvements will find equal applicability to other types of electronic article surveillance systems, or even other antenna applications where similar improvements are desired.

As discussed, the presently preferred implementation of the paired-lead antennas which embody the invention is by means of a twin-axial cable. A cable suitable for the purpose is available from Belden Wire & Cable Company, P.O. Box 1980, Richmond, Ind. 47375, under their product number 9271.

However, it will be understood that other paired-lead systems may also be utilized. For example, it is also possible to make use of two discrete, generally parallel wires to form the antenna loop 15. Paired coaxial cables may also be used.

In any case, the individual leads are preferably uniformly spaced from one another throughout their lengths. Further, it is preferable for the paired-leads to be uniformly twisted along their lengths since this reduces the effect local irregularities.

When using a shielded set of paired leads, as in the case of the twin-axial cable previously discussed, it is appropriate to provide a break in that shield, to assist the leads inside the shield in performing their basic function as antenna elements. Such a break is represented at **9*a* in FIG. 2*a*, where the leads inside shield 9 become exposed. To maintain electrical continuity for shield 9, the upper and lower portions separated by the break are conductively connected by conducters 9*b* and 9*c***.

Although not illustrated, the same break arrangement is preferably provided for the antenna 5 of FIG. **2*b***.

In view of all the foregoing, it is desired that the scope of the present invention be defined only by the appended claims.

What is claimed is:

1. An antenna formed of paired leads in the form of a twin-axial cable and including a first lead for connection to an active load, and a second lead extending along said first lead, for connection to a passive load, said second lead being mutually coupled with but not conductively connected to said first lead, wherein said active load is a receiver, said receiver forms part of an electronic article surveillance system, and said electronic article surveillance system includes means for reporting alarms, said means being electrically connected to said receiver by said second lead.

2. The antenna of claim 1 wherein said passive load is resistive.

3. The antenna of claim 2 wherein said passive load modifies the overall response of said antenna.

4. The antenna of claim 3 wherein said antenna exhibits a relatively constant amplitude response and relatively linear phase response over a predetermined frequency range.

5. The antenna of claim 4 wherein said predetermined frequency range corresponds to a range of resonant frequencies of the resonant circuits associated with tags of said electronic article surveillance system.

6. The antenna of claim 1 wherein said electronic article surveillance system further comprises a transmitter.

7. The antenna of claim 1 wherein said antenna is configured as a far-field cancelling loop antenna structure.

8. The antenna of claim 1 wherein the paired leads of said twin-axial cable are twisted about each other.

9. The antenna of claim 1 wherein said paired leads are substantially uniformly spaced from one another along their length.

10. The antenna of claim 1 wherein said antenna exhibits a relatively constant amplitude response and relatively linear phase response over a predetermined frequency range which corresponds to a range of resonant frequencies for resonant circuits associated with tags of said electronic article surveillance system.

11. An electronic article surveillance system for interacting with tag means including a resonant circuit, comprising:

a transmitter for generating a signal having a frequency at the resonant frequency of said resonant circuit;

a first antenna connected to said transmitter for producing a field exposed to said tag means;

a second antenna for receiving signals generated by said tag means responsive to said field; and a receiver connected to said second antenna for detecting the signals generated by said tag means;

wherein at least said first antenna or said second antenna is formed of paired leads in the form of a twin-axial cable including a first lead for connection to an active load, and a second lead for connection to a passive load and mutually coupled with, but not conductively connected to said first lead.

12. The system of claim 11 wherein said active load is said transmitter, and said passive load modifies the characteristic response of said first antenna to said transmitter without resistively loading said transmitter.

13. The system of claim 11 wherein said active load is said receiver, and said passive load modifies the characteristic response of said receiver to said second antenna without resistively loading said receiver.

14. The system of claim 13 wherein said electronic article surveillance system includes means for reporting alarms, electrically connected to said receiver by the second lead of said second antenna.

15. The system of claim 11 wherein the paired leads of said twin-axial cable are twisted about each other.

16. The system of claim 11 wherein both said first antenna and said second antenna are formed of a twin-axial cable including a first lead for connection to an active load, and a second lead for connection to a passive load and mutually coupled with, but not conductively connected to said first lead.

17. The system of claim 11 wherein said first antenna and said second antenna are configured as far-field cancelling loop antennas.

* * * * *